US010156129B2

(12) United States Patent
Chang

(10) Patent No.: US 10,156,129 B2
(45) Date of Patent: Dec. 18, 2018

(54) METHOD TO CREATE CONNECTIVITY BETWEEN WELLBORE AND FORMATION

(71) Applicant: Saudi Arabian Oil Company, Dhahran (SA)

(72) Inventor: Fakuen Frank Chang, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 378 days.

(21) Appl. No.: 14/792,704

(22) Filed: Jul. 7, 2015

(65) Prior Publication Data

US 2016/0003015 A1 Jan. 7, 2016

Related U.S. Application Data

(60) Provisional application No. 62/021,461, filed on Jul. 7, 2014.

(51) Int. Cl.
*E21B 43/114* (2006.01)

(52) U.S. Cl.
CPC ..... *E21B 43/114* (2013.01)

(58) Field of Classification Search
CPC ... E21B 43/114; E21B 43/11; E21B 43/11852
USPC ..... 166/298, 300
See application file for complete search history.

(56) References Cited

U.S. PATENT DOCUMENTS 2,918,125 A * 12/1959 Sweetman ..... E21B 29/02 148/201
4,446,920 A * 5/1984 Woytek ..... E21B 29/02 149/108.2
4,531,590 A 7/1985 Peterson
4,613,394 A 9/1986 Terrell et al.
5,603,384 A 2/1997 Bethel et al.
7,363,860 B2 * 4/2008 Wilson ..... F42B 3/02 102/205

(Continued)

OTHER PUBLICATIONS

International Search Report and Written Opinion issued in related PCT application PCT/US2015/039337; dated Oct. 21, 2015; 11 pages.

(Continued)

*Primary Examiner* — Michael R Wills, III
(74) *Attorney, Agent, or Firm* — Bracewell LLP; Constance Gail Rhebergen

(57) ABSTRACT

A jetting gun placed in a wellbore in a formation for penetrating the formation to create perforation tunnels comprising a pressure vessel, the pressure vessel comprising a propellant chamber and a nozzle, the pressure vessel configured to withstand a pressure of the wellbore, the nozzle embedded in the pressure vessel in a predetermined orientation, such that the propellant chamber is in fluid communication with the wellbore. The propellant chamber fully enclosed within the pressure vessel configured to hold a jetting fluid and an energetic material, wherein the energetic material is operable to generate pressure within the propellant chamber when activated such that the pressure projects the jetting fluid through the nozzle to create an impact fluid to penetrate the formation to create the perforation tunnels. The jetting gun also includes a detonating mechanism configured to activate the energetic material to generate the pressure within the propellant chamber.

18 Claims, 4 Drawing Sheets

(56) References Cited

U.S. PATENT DOCUMENTS

| | | | | |
|---|---|---|---|---|
| 7,387,072 | B2 * | 6/2008 | Hunn | B26F 3/004 102/367 |
| 8,079,296 | B2 | 12/2011 | Barton et al. | |
| 8,622,132 | B2 | 1/2014 | Coffey et al. | |
| 8,807,213 | B2 | 8/2014 | Walker et al. | |
| 9,388,673 | B2 * | 7/2016 | Grove | E21B 43/11852 |
| 2004/0089450 | A1 | 5/2004 | Slade et al. | |
| 2006/0196665 | A1 | 9/2006 | LaGrange et al. | |
| 2008/0073081 | A1 | 3/2008 | Frazier et al. | |
| 2009/0183916 | A1 | 7/2009 | Pratt et al. | |
| 2009/0242198 | A1 | 10/2009 | Evans et al. | |
| 2011/0000669 | A1 | 1/2011 | Barlow et al. | |
| 2014/0008069 | A1 | 1/2014 | Moore | |
| 2014/0299322 | A1 | 10/2014 | Underdown | |

OTHER PUBLICATIONS

PCT International Search Report and The Written Opinion of the International Searching Authority dated Oct. 21, 2015; International Application No. PCT/US2015/039337; International Filing Date: Jul. 7, 2014.

* cited by examiner

METHOD TO CREATE CONNECTIVITY BETWEEN WELLBORE AND FORMATION

RELATED APPLICATION

This application claims priority from U.S. Provisional Application No. 62/021,461, filed on Jul. 7, 2014. For purposes of United States patent practice, this application incorporates the contents of the Provisional Application by reference in its entirety.

FIELD OF THE INVENTION

This invention relates to an apparatus and method to perforate a formation.

BACKGROUND OF THE INVENTION

In cased and cemented wells, before oil and gas can be produced, the wellbore must be perforated to provide connectivity between the formation and the wellbore. Connectivity between the formation and the wellbore is necessary to produce hydrocarbons at the well. The more efficient the connectivity, the more likely it will be for hydrocarbons to move from the formation to the wellbore. In wells that are to be hydraulically fractured, the efficiency of connectivity can be significantly improved by ensuring that the plane enclosing the perforation tunnels, defined as fracture initiation plane, is properly aligned with the in-situ stress orientation of the formation.

SUMMARY OF THE INVENTION

This invention relates to an apparatus and method to perforate a formation. More specifically, this invention relates to an apparatus and method to perforate a casing and cement to create perforation tunnels in a formation using a jetting fluid and an energetic material.

In one aspect of the present invention, a jetting gun placed in a wellbore in a formation for penetrating the formation to create perforation tunnels is provided. The jetting gun includes a pressure vessel, the pressure vessel includes a propellant chamber and a nozzle, the pressure vessel is configured to withstand a pressure of the wellbore. The nozzle is embedded in the pressure vessel in a predetermined orientation, such that the propellant chamber is in fluid communication with the wellbore. The nozzle has a cross-sectional shape. The propellant chamber is fully enclosed within the pressure vessel and is configured to hold a jetting fluid and an energetic material. The energetic material is operable to generate pressure within the propellant chamber when activated such that the pressure is operable to project the jetting fluid through the nozzle to create an impact fluid. The impact fluid is operable to penetrate the formation to create the perforation tunnels. The jetting gun further includes a detonating mechanism, the detonating mechanism configured to activate the energetic material to generate the pressure within the propellant chamber.

In certain aspects of the present invention, the jetting gun includes more than one pressure vessel. In certain aspects the cross-sectional shape of the nozzle is selected from the group consisting of circular, elliptical, flat, square, rectangular, and triangular. In certain aspects of the present invention, the pressure vessel includes more than one nozzle. In certain aspects of the present invention, the jetting fluid is an incompressible fluid. In certain aspects of the present invention, the jetting fluid includes an abrasive solid. In certain aspects of the present invention, the energetic material is selected from the group consisting of an explosive, propellant, exothermic reaction chemical, and combinations thereof. In certain aspects of the present invention, the detonating mechanism is selected from the group consisting of an electrical detonator, a percussion detonator, a temperature activator, a chemical reaction activator, and combinations thereof. In certain aspects of the present invention, the impact fluid leaves the perforation unobstructed. In certain aspects of the present invention, the more than one nozzle is arranged in a perforating configuration, where the perforating configuration is selected from the group consisting of configurations in a transverse plane crossing a wellbore axis, configurations linearly along the wellbore axis, configurations in a helical pattern, and combinations thereof. In certain aspects of the present invention, the impact fluid is operable to penetrate a casing and a cement prior to penetrating the formation.

In a second aspect of the present invention, a method of creating perforation tunnels in a formation using a jetting gun is provided. The method includes the steps of introducing the jetting gun into a wellbore in the formation, such that the jetting gun is positioned adjacent to the formation, the jetting gun including a pressure vessel configured to withstand a pressure of the wellbore, the pressure vessel including a nozzle, the nozzle embedded in the pressure vessel in a predetermined orientation, such that a propellant chamber is in fluid communication with the wellbore, the nozzle having a cross-sectional shape, a propellant chamber, the propellant chamber fully enclosed within the pressure vessel, the propellant chamber configured to hold a jetting fluid and an energetic material, and a detonating mechanism, the detonating mechanism configured to activate the energetic material to generate the pressure within the propellant chamber. The method further includes the step of activating the energetic material with the detonating mechanism, wherein activating the energetic material is operable to generate a pressure within the propellant chamber. The pressure is operable to project the jetting fluid through the nozzle to create an impact fluid, where the nozzle is configured to direct the impact fluid onto the formation. The method further includes the step of allowing the impact fluid to penetrate the formation to create the perforation tunnels.

In certain aspects of the present invention, the jetting gun includes more than one pressure vessel. In certain aspects of the present invention, the cross-sectional shape of the nozzle is selected from the group consisting of circular, elliptical, flat, square, rectangular, and triangular. In certain aspects of the present invention, there is more than one nozzle. In certain aspects of the present invention, the jetting fluid is an incompressible fluid. In certain aspects of the present invention, the jetting fluid comprises an abrasive solid. In certain aspects of the present invention, the energetic material is selected from the group consisting of an explosive, propellant, exothermic reaction chemical, and combinations thereof. In certain aspects of the present invention, the detonating mechanism is selected from the group consisting of an electrical detonator, a percussion detonator, a temperature activator, a chemical reaction activator, and combinations thereof. In certain aspects of the present invention, the impact fluid leaves the perforation unobstructed. In certain aspects of the present invention, the impact fluid penetrates a casing and a cement prior to penetrating the formation. In certain aspects of the present invention, the more than one nozzle is arranged in a perforating configuration, the perforating configuration is selected from the group consisting of configurations in a transverse plane crossing a wellbore axis, configurations linearly along the wellbore axis, configurations in a helical pattern, and combinations thereof.

BRIEF DESCRIPTION OF THE DRAWINGS

These and other features, aspects, and advantages of the present invention will become better understood with regard to the following descriptions, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION OF THE INVENTION

Figure 1:
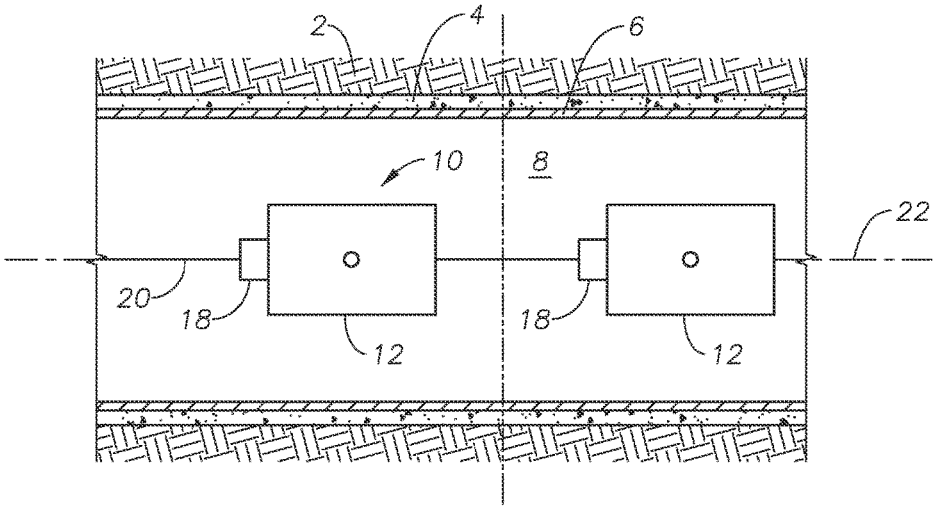
FIG. 1 is an elevation plan view of an embodiment of the present invention.

While the invention will be described with several embodiments, it is understood that one of ordinary skill in the relevant art will appreciate that many examples, variations and alterations to the apparatus and methods described herein are within the scope and spirit of the invention. Accordingly, the exemplary embodiments of the invention described herein are set forth without any loss of generality, and without imposing limitations, on the claimed invention.

In unconventional formations, hydraulic fracturing and horizontal wells play an important role in successful exploitation and production. Hydraulic fracturing in horizontal wells can be the key to producing hydrocarbons from shale, tight sands, and carbonate formations. Perforation operations are especially important in shale gas and tight sand wells, which are cased and perforated prior to hydraulic fracturing.

Perforating the casing and cement can be achieved by a number of means, but the most common technique is to perforate the casing and cement with shaped charges. Shaped charges typically have a lined hollow in one end, usually conical in shape, such that the detonation of the explosive causes the liner to collapse and project away from the explosive and, in this case, through the casing and cement and into the formation. Shaped charges are advantageous because they are capable of creating thousands of perforation tunnels in milliseconds.

While shaped charges are effective at perforating the casing, cement, and wellbore, they can also cause significant formation damage and therefore reduce the effective connectivity between the wellbore and formation. Shaped charges leave significant amounts of debris in the perforation tunnels. The debris can plug the perforation tunnels along with the holes in the casing and cement and cause formation damage. The plugging problem is of greater concern in low permeability shale and tight sand formations due to an insufficient back flow of hydrocarbons from the formation to the wellbore to clean the perforation of debris. Plugged perforation tunnels may cause high fracture pressure and reduce the ability of hydraulic fluids to fracture the formation. While other reasons, such as rock mechanical properties and in-situ stress, could lead to an inability to fracture the rock, plugged perforations are a contributing factor. Finally, it is difficult to customize shaped charges to align the perforation tunnels with the in-situ stress of the formation. Shaped charges are limited in their perforation configurations to clusters of spiral patterns. The spiral patterns cannot be designed to align with a preferred fracture plane so as to optimize the fracture initiation, instead the spiral pattern causes multiple competing fractures and a tortuous flow path. Shaped charges do not enable optimization of the hydraulic fracturing treatment.

An alternative for creating perforation tunnels is to use a jet of water. Water, at pressures above 10,000 psi can be used to cut metal and rock. Water has the added benefit of leaving a neat cutting surface. Conventional water jets, however, require hydraulic pressure from a pump to reach the high pressures needed. To use conventional water jets in wellbores, long runs of tubing are required to reach the formation and high pressure pumps must be capable of exceeding the pressure drop in the tubing in order to deliver the pressure needed to penetrate the formation.

An alternative to shaped charges that allows for more control over the perforation configurations to align with in-situ stress faults is desirable. An alternative that makes use of existing well completion tools and procedures would be advantageous. An alternative that creates perforation tunnels free of debris, and limits permeability impairment is desirable.

Referring to FIG. 1, an embodiment of the present invention is provided. Jetting gun 10 on slickline 20 is positioned in wellbore 8 adjacent to the perforation location. In alternate instances, jetting gun 10 can be attached to and positioned in wellbore 8 with coiled tubing (not shown), pipe (such as a drill string) (not shown), a towed robot (not shown), or any other means for conveyance for positioning an apparatus into a wellbore. The "perforation location" as used herein refers to the location in wellbore 8 where perforation tunnels are to be created. The perforation location is a zone of the formation that contains oil and gas bearing rock and where a connection between the wellbore and the oil and gas bearing rock is desired. The zone that contains oil and gas bearing rock and the associated perforation location is determined during the drilling and well logging process by methods common in the drilling industry. Such methods allow the production engineers to determine where to fracture for maximizing the well productivity. The location in a wellbore is determined during the logging process and the length of slickline or other the means for conveyance used to position the jetting gun is correlated against the location so the jetting gun is delivered to predetermined depth. In one instance of the present invention, wellbore 8, in formation 2, is complete with casing 6 and cement 4. "Wellbore" as used herein refers to a drilled holed defined by a borehole, and used to connect a formation to a surface, where the wellbore traverses the formation. Casing 6 and cement 4 are completed according to common methods known in the industry with commonly used casing and cementing materials. In one instance of the present invention, wellbore 8 is an openhole wellbore that is uncased and uncemented. Formation 2 can be any type of formation containing a reservoir fluid. The reservoir fluid can contain hydrocarbons, water, or combinations thereof. In at least one instance of the present invention formation 2 is shale. In at least one instance of the present invention, formation 2 is sandstone. In at least one instance of the present invention, formation 2 is carbonate.

Wellbore 8 has a configuration that extends through the formation. The configuration of wellbore 8 relative to the surface of the earth can be vertical, horizontal, deviated, or a combination thereof. The configuration of wellbore 8 can include vertical, horizontal, and deviated in one well as the well adjusts to the formation.

Figure 2:
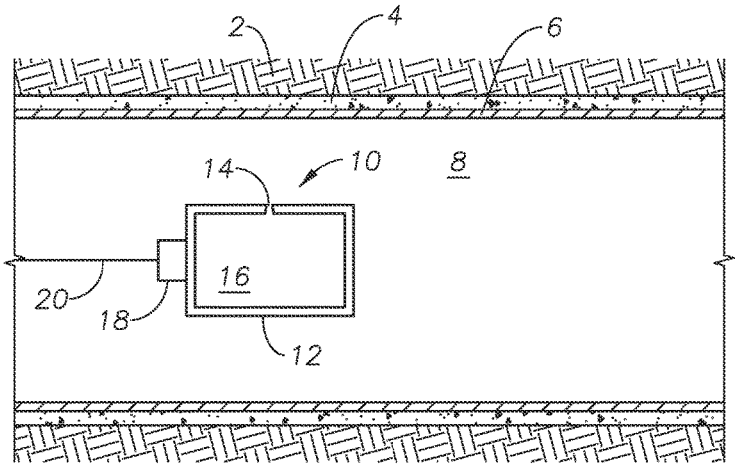
FIG. 2 is a sectional view in elevation of an embodiment of the present invention.

Jetting gun 10 is positioned within wellbore 8 to have a clearance between wellbore 8 and jetting gun 10. The "clearance" refers to the space between jetting gun 10 and wellbore 8. The clearance is between 0.25 inches and 2 inches, alternately between 0.5 inches and 2 inches, alternately between 1 inch and 2 inches, and alternately between 1.5 inches and 2 inches. Jetting gun 10 includes pressure vessel 12 and detonating mechanism 18. Jetting gun 10 includes at least one pressure vessel 12. In some instances, jetting gun 10 includes two or more pressure vessels 12. The number of pressure vessels 12 is influenced by formation considerations. Formation considerations, as used herein, encompasses considerations of the type of formation 2, the reservoir pressure in formation 2, the reservoir fluid being produced, the length of formation 2 in contact with wellbore 8, and the configuration of wellbore 8. Referring to FIG. 2, and incorporating the information disclosed with reference to FIG. 1, pressure vessel 12 includes nozzle 14 and propellant chamber 16.

Pressure vessel 12 can be any rigid container of any material that does not deform as a result of a change in external pressure exerted by wellbore 8 or internal pressure exerted by the activation of the energetic material. In at least one instance of the present invention, pressure vessel 12 is constructed from carbon steel. The need for hydrodynamic efficiency in jet development within pressure vessel 12 is one consideration in selecting the shape of pressure vessel 12. The configuration of wellbore 8 is another consideration in selecting the shape of pressure vessel 12. Pressure vessel 12 can be any shape capable of being inserted in wellbore 8. Exemplary shapes for pressure vessel 12 include a rectangular prism, a cube (square prism), a cylinder, an ovoid, and a sphere. In at least one instance of the present invention, pressure vessel 12 is a rectangular prism. The volume of pressure vessel 12 is calculated from the volume of jetting fluid needed to create perforation tunnels. The volume of jetting fluid needed to create perforation tunnels is determined based on desired tunnel geometry, including depth, width, and cross-sectional shape, and jet requirements. Fracture considerations, as used herein, encompass considerations of the type of formation 2, the depth of penetration desired, the extent of the need for fracture initiation, in-situ stress plane orientation (the known minimum horizontal in-situ stress), the fracturing process to be used, and the need to optimize the efficiency of the fracturing process and hydrocarbon recovery. Jet requirements, as used herein, encompass the pressure of the jet required and the size of the perforation tunnels to be created. One of skill will appreciate that other factors can be considered in designing pressure vessel 12. In at least one instance of the present invention, the pressure of the jet required depends on fracture considerations. The dimensions of pressure vessel 12 are governed by the configuration of wellbore 8, the volume of pressure vessel 12, and the number, size, predetermined orientation, and perforating configuration of nozzles 14.

Nozzle 14 is embedded in an external wall of pressure vessel 12 providing a path from propellant chamber 16 to wellbore 8. As used herein, "embedded" means nozzle 14 is fixed in the wall of pressure vessel 12, such that nozzle 14 is the fluid conduit providing a fluid flow pathway selectively between propellant chamber 16 and wellbore 8. In at least one instance of the present invention, nozzle 14 includes an isolation device (not shown) that isolates propellant chamber 16 from wellbore 8. Exemplary isolation devices include caps, plugs, seals, check valves or any other device that can resist deformation due to a pressure differential between pressure vessel 12 and wellbore 8, but can allow pass of the fluid through nozzle 14 when the pressure in pressure vessel 12 increases. In at least one instance of the present invention, nozzle 14 is fitted with a check valve so the wellbore fluid can enter pressure vessel 12, but not escape from pressure vessel 12. In at least one instance, nozzle 14 can be embedded to align flush with an external wall of pressure vessel 12. In at least one instance of the present invention, nozzle 14 can be embedded to protrude beyond an external surface of pressure vessel 12. In at least one instance of the present invention, nozzle 14 can be recessed within a surface of pressure vessel 12. Jetting gun 10 can include a plurality of nozzles. Jetting gun 10 can include more than one nozzle 14 embedded in pressure vessel 12, alternately more than two nozzles 14, alternately more than three nozzles 14, alternately more than four nozzles 14, alternately more than five nozzles 14, alternately more than six nozzles 14, alternately more than seven nozzles 14, alternately more than eight nozzles 14, alternately more than nine nozzles 14, alternately more than ten nozzles 14, alternately less than ten nozzles 14, and alternately less than five nozzles 14. In at least one instance of the present invention, there are more than two nozzles 14 embedded in pressure vessel 12. The number of nozzles 14 is determined from the fracture considerations and the jet requirements.

The cross-sectional shape of nozzle 14 dictates the shape of the impact fluid and is controlled by perforation considerations and jet requirements. The cross-sectional shape of nozzle 14 is the cross-section shape of the plane perpendicular relative to the path or direction of fluid flow through nozzle 14. Nozzle 14 can have any cross-sectional shape capable of propelling the impact fluid through casing 6 and cement 4 and into formation 2. Exemplary cross-sectional shapes include circular, elliptical, flat (line), square, rectangular, or triangular. In at least one instance of the present invention, the cross-sectional shape of nozzle 14 is circular. In at least one instance of the present invention, nozzle 14 has a uniform cross-sectional area. In at least one instance, nozzle 14 is a cylinder with uniform cross-sectional area. In at least one instance of the present invention, nozzle 14 has varying cross-sectional areas. Nozzle 14 can be convergent, divergent, or convergent-divergent. In at least one instance of the present invention, nozzle 14 is convergent. The impact fluid created by nozzle 14 is a jet. A jet, as used herein, means a coherent fluid stream that exceeds the pressure to perforate formation 2 and that can travel the distance between the jetting gun and the formation, including a distance into the formation, with little or no dissipation between the jetting gun and the formation. It is understood that in order to perforate formation 2 the impact fluid must also perforate casing 6 and cement 4, all references to perforating formation 2 or creating perforation tunnels include the process or step of first perforating casing 6 and cement 4, unless explicitly stated otherwise. In some instances of the present invention, the impact fluid produced by nozzle 14 is a shaped spray. Exemplary shaped sprays include a fan or line spray, a spiral spray, an elliptical shaped spray, and a hollow spray. A "hollow spray" refers to a spray that has a hollow cone spray pattern.

Nozzle 14 can be any material that can withstand the pressure and temperature within wellbore 8 and the pressure exerted from within propellant chamber 16. In at least one instance of the present invention, nozzle 14 is a commercially available nozzle. In at least one instance of the present invention, nozzle 14 is drilled out of pressure vessel 12, such that nozzle 14 is a hole defined by the wall of the vessel.

The size of nozzle 14 is determined from fracture considerations, jet requirements, and the number of nozzles 14 embedded in pressure vessel 12. Nozzle 14 can be a standard drill bit size, a standard commercially available nozzle, or a custom sized nozzle. In preferred instances of the present invention, the size of nozzle 14 is a diameter between about 0.25 inches to about 0.5 inches. The force exerted by the jet on the formation is based on the Bernoulli principle, which relates pressure and fluid velocity, where the pressure in the pressure vessel drives the fluid through the nozzle. As the fluid velocity is a function of the nozzle size and the flow rate, the smaller the nozzle size the greater the fluid velocity for a given flow rate. However, friction losses occur in nozzles, with smaller nozzles experiencing higher friction losses. The total force exerted on the formation is can be expressed as the kinetic energy of the fluid moving through the nozzle, where the kinetic energy is a function of the fluid velocity and the fluid mass $$E_k = \frac{1}{2}mv^2 \qquad \text{equation 1}$$

Therefore, nozzle 14 is sized in consideration of the required fluid velocity necessary to produce sufficient energy to penetrate the formation.

Figures 3A, 3B, 3C, 3D:
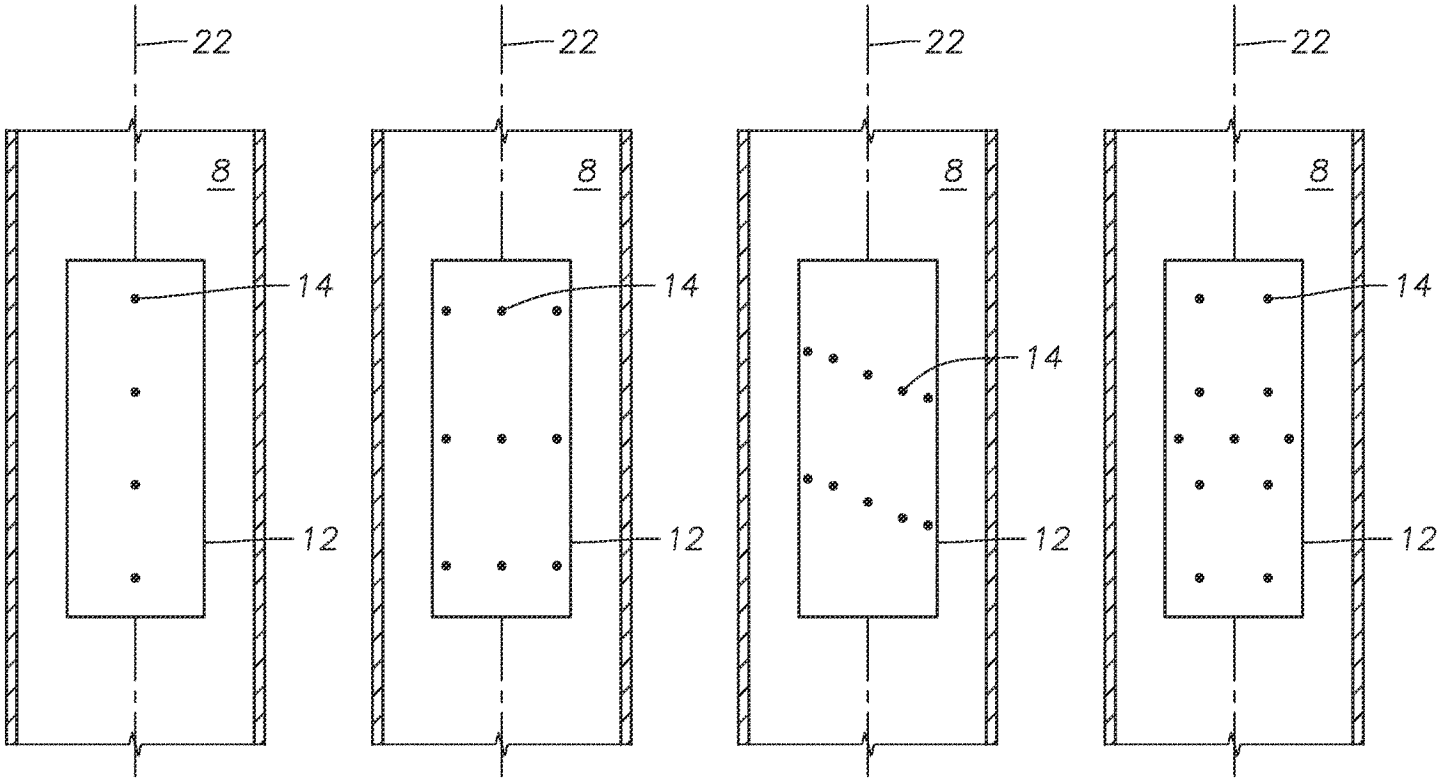
FIG. 3*a-d* top views of different perforating configurations are provided.

Nozzle 14 is embedded in pressure vessel 12 in a predetermined orientation. The predetermined orientation includes an angle relative to a plane of pressure vessel 12, an angle relative to a plane of formation 2, and a location on pressure vessel 12. "A plane of formation 2" refers to a plane bisecting formation 2 that would be chosen based on seismic data or other method in the art. In at least one instance of the present invention, a plane of formation 2 is selected to take advantage of fault lines in the formation. The predetermined orientation controls where the impact fluid is directed relative to and into the formation. Where pressure vessel 12 includes more than one nozzle 14, nozzles 14 are arranged in a perforating configuration. As used herein, "perforating configuration" refers to the pattern of nozzles 14 embedded in pressure vessel 12 relative to the axis of pressure vessel 12, with the selected pattern based on formation considerations, fracture considerations, jet requirements, predetermined orientation, and the configuration of wellbore 8. Exemplary perforating configurations include linearly along axis 22 of wellbore 8, transversely across axis 22 of wellbore 8, in a helical pattern, and combinations thereof. As used herein, "axis of wellbore" refers to the axis running through the center of the wellbore, and is relative to the location of the jetting gun as would be determined through seismic data, data collected during wellbore drilling operations, or other methods known in the art and is not meant to encompass the axis of the entire length of the wellbore from the surface to the end. There can be more than one row of nozzles 14 embedded in a surface of pressure vessel 12. Referring to FIG. 3*a-d* different perforating configurations are shown. FIG. 3*a* provides a top view of pressure vessel 12 in wellbore 8. Nozzles 14 are arranged in one row linearly along axis 22 of wellbore 8. FIG. 3*b* provides a top view of pressure vessel 12 where nozzles 14 are arranged transversely across axis 22 of wellbore 8 in three rows. FIG. 3*c* provides a top view of a pressure vessel 12 where nozzles 14 are arranged in a helical pattern. FIG. 3*d* provides a top view of pressure vessel 12 where nozzles 14 are arranged in two rows linearly along the axis 22 of wellbore 8 and transversely across the axis 22 of wellbore 8 in one row. The perforating configurations of FIGS. 3*a-d* are meant as example perforating configurations only and are not meant to be limiting, and it should be understood that any combination of rows and alignment can be used. In at least one instance of the present invention, the predetermined orientation and the perforating configuration of nozzles 14 are tailored such that the impact fluid streams from each nozzle 14 are parallel to each other. In at least one instance of the present invention, the predetermined orientation and the perforating configuration of nozzles 14 are tailored such that the impact fluid streams from each nozzle 14 cross paths at a point prior to impacting formation 2 or at a point after perforating formation 2.

The predetermined orientation and the perforating configuration can be tailored to align nozzles 14, such that the perforation tunnels created are aligned with in-situ stress planes in formation 2. Aligning the perforation tunnels with in-situ stress planes increases the efficiency of the connectivity between formation 2 and wellbore 8, because alignment facilitates fracture initiation, reduces fracture breakdown, and minimizes tortuosity of the fractures during the hydraulic fracturing step.

Figure 5:
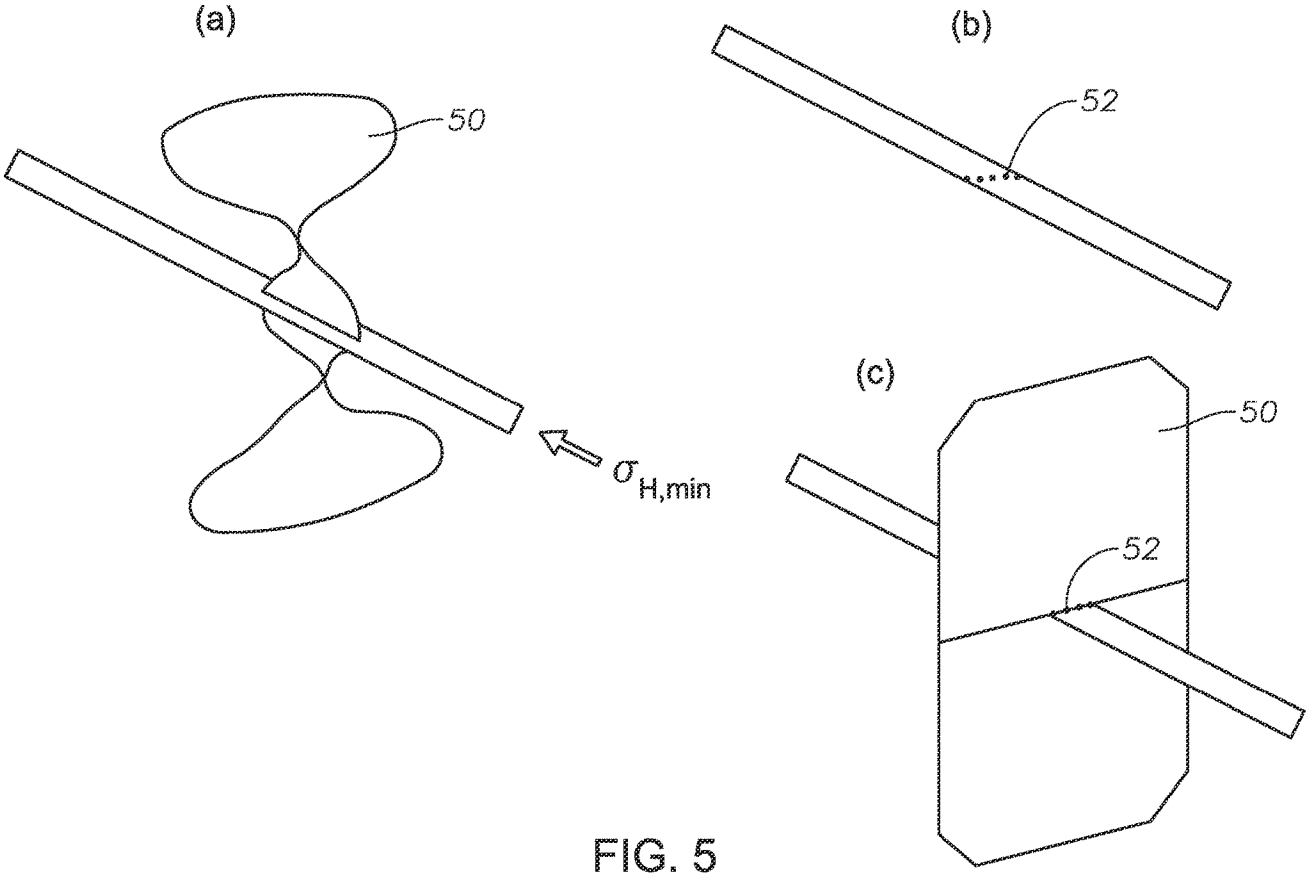
FIG. 5 is a diagrammatic representation of the fracture plane relative to the known minimum horizontal in situ stress.

In at least one instance of the present invention, nozzles 14 are in a perforating configuration in a plane perpendicular to the known minimum horizontal in situ stress, the cross-sectional shape of nozzles 14 is a line or narrow rectangle of predetermined orientation, the impact fluid from each nozzle 14 therefore overlaps at least one other nozzle 14, and the result is a semi-circular notch in formation 2. The notch minimizes the fracture initiation pressure and aligns the induced fractures as they propagate away from wellbore 8 to minimize the tortuosity during fracturing. FIG. 5 provides a drawing to illustrate this point. In (a) the minimum stress plane is denoted by $\sigma_{H,\ min}$ and the fracture or fracture plane is denoted by 50. The minimum stress plane $\sigma_{H,\ min}$ is in the same direction as the wellbore axis. The fracture is initiated along the wellbore, but rotates to the preferred fracture plane (perpendicular to the minimum stress plane) and creates tortuosity in the fracture plane, illustrated by the twist in fracture plane 50. In (b), the perforating configuration creates perforations 52 in a plane perpendicular to the minimum stress plane. As shown in (c), when the fracture 50 is initiated, it is initiated from the perforations 52 and aligns with the preferred fracture plane. There is no tortuosity as the fracture propagates.

The depth of the perforation tunnels is a function of jetting fluid volume, jet requirements, formation considerations, and fracture considerations. In at least one instance of the present invention, the depth of a penetration tunnel is about one wellbore diameter deep into formation 2. In at least one instance of the present invention, the depth of a penetration tunnel is between about 4" to about 12".

Figure 4:
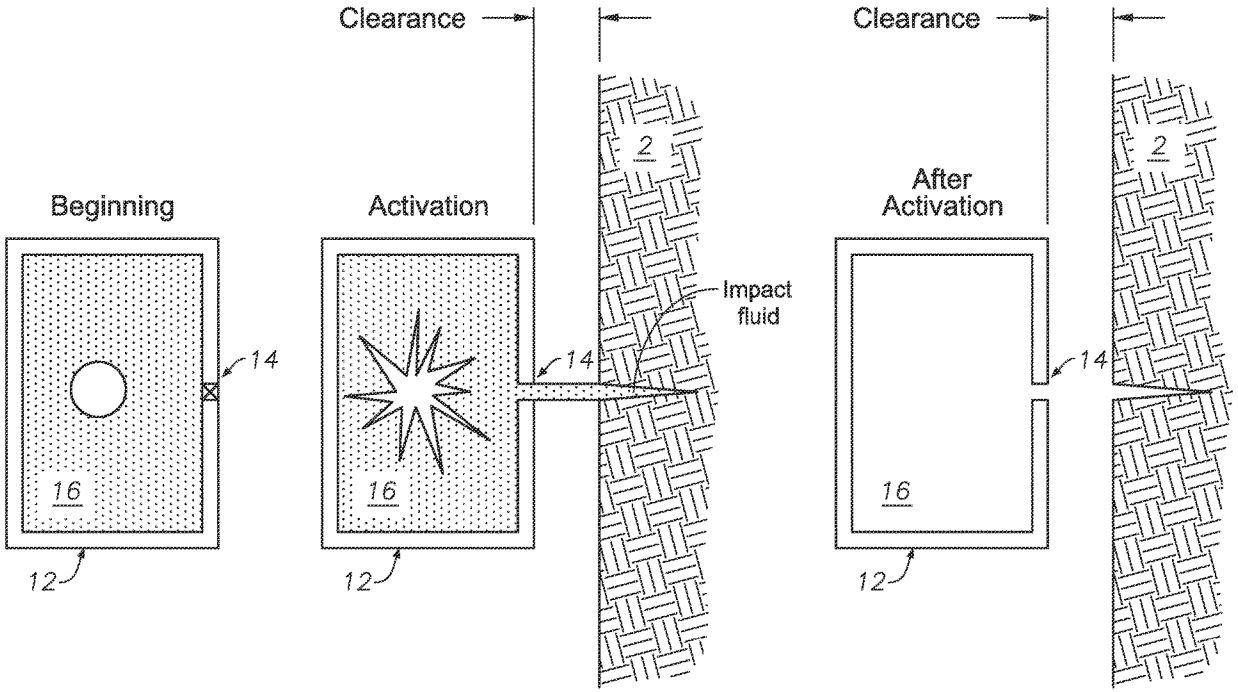
FIG. 4 is a diagrammatic representation of the activating of the energetic material and the creation of a perforation tunnel in a formation.

Propellant chamber 16 is configured to hold the jetting fluid and the energetic material. FIG. 4 illustrates an instance of the invention in which the energetic material is encased in a film away from the jetting fluid filling propellant chamber 16. In at least one instance of the present invention, a lining separate from pressure vessel 12 is the demarcation of propellant chamber 16. The jetting fluid and the energetic material are not in contact before the energetic material is activated. Any means for fluidly separating the jetting fluid and the energetic material that allows an activator to set in motion the energetic material and maintains its integrity before the energetic material is activated is suitable. In other words, the means for fluidly separating the jetting fluid and the energetic material prevents the energetic material from getting wet by the jetting fluid. Exemplary means for fluidly separating the jetting fluid and the energetic material includes bags, bladders, containers, films, and pouches any of which can be made from any thin impermeable material, such as rubbery, metal, or plastic materials. When the energetic material is activated, the means for fluidly separating the jetting fluid and the energetic material can be blown open or shattered.

The jetting fluid is any incompressible fluid capable of impacting formation 2 and creating a perforation tunnel. The jetting fluid is in the absence of compressible fluids, such as gases. In some instances, the jetting fluid can be a non-Newtonian fluid, such as a gel. The non-Newtonian fluid can be a gel containing solid abrasives to make a slurry. Exemplary jetting fluids include wellbore fluids, water, acids, and combinations thereof. Exemplary acids include hydrochloric acid, acetic acid, and formic acid. In at least one instance of the present invention, the jetting fluid is water. In at least one instance of the present invention, the jetting fluid includes abrasive solids. Abrasive solids as used herein refers to solid components or particles that can enhance the ability of the impact fluid to cut through the formation, by wearing away the formation where the abrasive solids rub against the formation. Exemplary abrasive solids include sand, salts, proppants, and metal powders.

The energetic material is any material capable of increasing the pressure in propellant chamber 16 when activated. Exemplary energetic materials include explosives, propellants, and exothermic reaction chemicals. In at least one instance of the present invention, the energetic material is an explosive. Exemplary explosives include cyclotrimethylenetrinitramine (RDX), cyclotetramethylene-tetranitramine (HMX) and hexanitrostilbene (HNS). In at least one instance of the present invention, the energetic material is a propellant. Exemplary propellants include hydrocarbon gases, such as methane, ethane, propane, LPGs and jet fuel. In at least one instance of the present invention, where the energetic material is a propellant, the propellant is solid jet fuel. In at least one instance of the present invention, the energetic material includes an exothermic reaction chemical. In at least one instance of the present invention, the energetic material includes more than one exothermic reaction chemical, such that the energetic material includes exothermic reaction chemicals. In at least one instance of the present invention, the exothermic reaction chemical includes an oxidizer. Exemplary oxidizers include peroxides, chlorates, perchlorates, nitrates, halogens, and permanganates. Exemplary peroxides include barium peroxide, dibenzoyl peroxide, hydrogen peroxide, magnesium peroxide, potassium peroxide, and sodium peroxide. In at least one instance of the present invention, the energetic material is hydrogen peroxide. In at least one instance of the present invention, the exothermic reaction chemicals include ammonium chloride ($NH_4Cl$) and sodium nitrite ($NaNO_2$) In some instances of the present invention, the energetic material is encapsulated within the jetting fluid of propellant chamber 16. In some instances of the present invention, the energetic material is mixed within the jetting fluid of propellant chamber 16.

When activated, the energetic material increases the pressure in propellant chamber 16. In one instance of the present invention, the energetic material increases the pressure in propellant chamber 16 because the energetic material expands. The energetic material increases the pressure in propellant chamber 16 in less than about 1 second, alternately in less than about 1 millisecond, alternately in less than about 0.1 milliseconds, alternately in less than about 0.01 milliseconds (or 10 microseconds), or alternately in less than about 1 microsecond. The increased pressure projects the jetting fluid through nozzle 14 creating the impact fluid. As used herein, "projects" means the increased fluid forces, propels and drives the jetting fluid, such that the jetting fluid exits propellant chamber 16 through nozzle 14. The impact fluid is a jet of pressurized fluid egressing from propellant chamber 16 via the fluid conduit formed by nozzle 14. The impact fluid penetrates the formation creating the perforation tunnels.

Detonating mechanism 18 can be any mechanism capable of activating the energetic material. Exemplary detonating mechanisms 18 include an electrical detonator, a percussion detonator (for example a mechanically-initiated blasting cap), a temperature activator, and a chemical reaction activator. Exemplary electrical detonators include instantaneous electrical detonators (IED), short period delay detonators (SPD), and long period delay detonators (LPD). In SPDs, delay periods are measured in milliseconds. In LPDs, delay periods are measured in seconds. In percussion detonation, the activator is the mechanical impact of a firing pin. The firing pin strikes a detonator containing an abrasive and a high sensitivity explosive. The mechanical impact generates heat and energy on the abrasive and high sensitivity explosive, the heat and energy ignites the energetic material, which creates a shockwave. The shockwave is a supersonic shockwave. In at least one instance of the present invention, the chemical reaction activator is a chemical catalyst. Detonating mechanism 18 can be a combination activator such as an electrical blasting cap, where an electric current heats a filament which sets off a lead azide, silver azide, or mercury fulminate energetic material. In at least one instance of the present invention, detonating mechanism 18 includes an electrical wire capable of conveying a current. The electrical wire can be incorporated on slickline 20. In at least one instance of the present invention, detonating mechanism 18 includes detonating cord.

As described herein, the increased pressure within propellant chamber 16 of jetting gun 10 due to the activating of the energetic material forces the jetting fluid through nozzles 14 as the impact fluid, which perforates formation 2 creating perforation tunnels. As the impact fluid loses pressure, the reservoir fluid flows from the perforation tunnels in formation 2 back to wellbore 8 and carries with it debris, such as crushed and compacted solids, rock fragments, and other detritus from casing 6, cement 4, and formation 2, leaving the perforation tunnel unobstructed. In at least one instance of the present invention, reducing a pressure of the impact fluid allows the reservoir fluid to flow from formation 2 through the perforation tunnels to wellbore 8 to be collected at the surface. As used herein, "unobstructed" means that the perforation tunnel is unobstructed or unblocked to fluid flow by debris, having a path by which hydrocarbons can flow from formation 2 through the perforation tunnel to wellbore 8. A perforation tunnel can contain residual debris, so long as the debris does not block the entire perforation tunnel or obstruct the perforation tunnel. In at least one instance of the present invention, the impact fluid carries debris into wellbore 8 even when the reservoir fluid lacks the pressure to move the debris from the path.

The present invention operates in the absence of shaped charges. In at least one instance of the present invention, nozzle 14 includes a backflow preventer that restricts the ability of fluid flow into jetting gun 10. In at least one instance of the present invention, nozzle 14 includes a backflow preventer that restricts the ability of fluid flow into jetting gun 10 after the jetting fluid has been expelled.

EXAMPLES

Proposed design of experimentation as illustrated in FIG. 4 includes the following prophetic examples.

Example 1

In Example 1, the energetic material includes 20 grams of HMX explosive. The explosive will be wrapped in a highly elastic rubber bladder and placed in a 10 liter cylindrical pressure vessel made of carbon steel. The pressure vessel will have one cylindrical nozzle, 0.75 inches in diameter. The pressure vessel with the explosive inside would be placed in the wellbore, and as the pressure vessel is run in the well, the wellbore fluid will enter the pressure vessel due to the pressure differential of the propellant chamber of the pressure vessel and the wellbore, with the wellbore fluid filling the propellant chamber with wellbore fluid as the jetting fluid. The nozzle be fitted with check valves so the wellbore fluid can enter the pressure vessel, but not escape from the pressure vessel. In at least one example, a tank of water would approximate the wellbore, and the tank will be filled with water or brine. The pressure vessel would be placed in a tank with brine as the wellbore fluid and separating the pressure vessel from a rock formation. The specific gravity of the water in the tank will be 1.1 under a static pressure of 5,000 psi. The explosive will be activated by an electrical detonator. After detonation, the pressure within propellant chamber is predicted to rise in 10 microseconds from 14.4 psi to 15,000-20,000 psi. The pressure is calculated according to the following equation (measurement with a pressure gauge is not feasible):

change in pressure=change in volume/original volume/fluid compressibility.

In Example 1, the fluid compressibility of the wellbore fluid is approximately $3\times10^{-6}$ (l/psi). The pressure would be considered to be uniform through the pressure vessel. The impact fluid leaving the nozzle is predicted to penetrate the rock formation.

Example 2

In Example 2, a two-gun jetting gun assembly will be carried by drill pipes into a 4.5" diameter horizontal well drilled in the direction of minimum earth stress. Each jetting gun will have a 15 liter cylindrical pressure vessel made of carbon steel for the propellant chamber. The outer diameter of the pressure vessel will be 3.5". The propellant chamber will be pre-filled with 14.85 liters of a water based gel as the jetting fluid. The water based gel has a specific gravity of 1.5. In addition, the propellant chamber will contain 100 mesh sand at a concentration of 10 lb/gal. The propellant chamber also will contain 0.15 liters of air to fill the additional space between the 14.85 liters of jetting fluid and the 15 liters of total propellant chamber volume. Air allows for the thermodynamic expansion of the jetting fluid while maintaining a constant pressure inside the propellant chamber of the jetting gun. Without being bound to a particular theory, it is believed that the expansion of the jetting fluid is due to the change in temperature from the surface, at ambient temperature, to the temperature at the bottom hole. Thirty grams of HNS explosive as the energetic material will be placed in the pressure vessel and sealed with plastic wrap to ensure that the explosive is not wetted by the jetting fluid. Each jetting gun will be fitted with six nozzles uniformly around the circumference of the jetting gun cylinder. Each nozzle will have a rectangular cross-sectional shape with the long edge of 25 mm in the jetting gun circumference direction and the short edge of 2.5 mm along the axis of the jetting gun. The configuration of the nozzles is predicted to result in a star jetting pattern perpendicular to the jetting gun and well bore axis. Each nozzle is capped to prevent fluid exchange between the inside of the jetting gun and the wellbore while running the jetting gun into the wellbore and before firing of the explosive. The pressure inside the propellant chamber of the jetting guns is predicted to be 14.7 psi whereas the wellbore pressure is 6000 psi. The explosive will be activated by a percussion detonator. After detonation, the pressure within the pressure vessel (propellant chamber) is predicted to rise in 100 microseconds from 14.7 psi to 25,000-40,000 psi. The pressure rise opens the cap on each nozzle and projects the jetting fluid through the nozzles to generate the impact fluid which is predicted to penetrate the rock formation resulting in a star/circular notch perpendicular to the jetting gun and well axis. The notching pattern facilitates the initiation of a transverse hydraulic fracture from each jetting gun by later hydraulic fracturing pumping treatment.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a," "an," and "the" include plural referents, unless the context clearly dictates otherwise.

Optional or optionally means that the subsequently described event or circumstances can or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present invention.

What is claimed is:

1. A jetting gun placed in a wellbore in a formation for penetrating the formation to create perforation tunnels, the jetting gun comprising:

a pressure vessel, the pressure vessel comprising a propellant chamber and more than one nozzle, the pressure vessel configured to withstand a pressure of the wellbore;

the more than one nozzle embedded in the pressure vessel in a predetermined orientation, such that the propellant chamber is in fluid communication with the wellbore, the nozzle having a cross-sectional shape wherein the more than one nozzle is arranged in a perforating configuration, where the perforating configuration is selected from the group consisting of configurations in a transverse plane crossing a wellbore axis, configurations linearly along the wellbore axis, configurations in a helical pattern, and combinations thereof, wherein the predetermined orientation and the perforating configuration are operable to align the perforation tunnels with in-situ stress planes in the formation; and the propellant chamber fully enclosed within the pressure vessel, the propellant chamber configured to hold a jetting fluid and an energetic material, wherein the energetic material is operable to generate pressure within the propellant chamber such that the pressure is operable to project the jetting fluid through the nozzle to create an impact fluid, and wherein the impact fluid is operable to penetrate the formation to create the perforation tunnels; and a detonating mechanism, the detonating mechanism configured to activate the energetic material to generate the pressure within the propellant chamber.

2. The jetting gun of claim 1, wherein the jetting gun comprises more than one pressure vessel.

3. The jetting gun of claim 1, wherein the cross-sectional shape of the nozzle is selected from the group consisting of circular, elliptical, flat, square, rectangular, and triangular.

4. The jetting gun of claim 1, wherein the jetting fluid is an incompressible fluid.

5. The jetting gun of claim 1, wherein the jetting fluid comprises an abrasive solid.

6. The jetting gun of claim 1, wherein the energetic material is selected from the group consisting of an explosive, propellant, exothermic reaction chemicals, and combinations thereof.

7. The jetting gun of claim 1, wherein the detonating mechanism is selected from the group consisting of an electrical detonator, a percussion detonator, a temperature activator, a chemical reaction activator, and combinations thereof.

8. The jetting gun of claim 1, wherein the impact fluid leaves the perforation unobstructed.

9. The jetting gun of claim 1, wherein the impact fluid is operable to penetrate a casing and a cement prior to penetrating the formation.

10. A method of creating perforation tunnels in a formation using a jetting gun, the method comprising the steps of:

introducing the jetting gun into a wellbore in the formation, such that the jetting gun is positioned adjacent to the formation, the jetting gun comprising:

a pressure vessel configured to withstand a pressure of the wellbore, the pressure vessel comprising:

more than one nozzle, the more than one nozzle embedded in the pressure vessel in a predetermined orientation, such that a propellant chamber is in fluid communication with the wellbore, the nozzle having a cross-sectional shape, wherein the more than one nozzle is arranged in a perforating configuration, the perforating configuration is selected from the group consisting of configurations in a transverse plane crossing a wellbore axis, configurations linearly along the wellbore axis, configurations in a helix pattern, and combinations thereof, wherein the predetermined orientation and the perforating configuration are operable to align the perforation tunnels with in-situ stress planes in the formation;

a propellant chamber, the propellant chamber fully enclosed within the pressure vessel, the propellant chamber configured to hold a jetting fluid and an energetic material, and a detonating mechanism, the detonating mechanism configured to activate the energetic material to generate the pressure within the propellant chamber;

activating the energetic material with the detonating mechanism, wherein activating the energetic material is operable to generate a pressure within the propellant chamber, and wherein the pressure is operable to project the jetting fluid through the nozzle to create an impact fluid, where the nozzle is configured to direct the impact fluid onto the formation; and allowing the impact fluid to penetrate the formation to create the perforation tunnels.

11. The method of claim 10, wherein the jetting gun comprises more than one pressure vessel.

12. The method of claim 10, wherein the cross-sectional shape of the nozzle is selected from the group consisting of circular, elliptical, flat, square, rectangular, and triangular.

13. The method of claim 10, wherein the jetting fluid is an incompressible fluid.

14. The method of claim 10, wherein the jetting fluid comprises an abrasive solid.

15. The method of claim 10, wherein the energetic material is selected from the group consisting of an explosive, propellant, exothermic reaction chemicals, and combinations thereof.

16. The method of claim 10, wherein the detonating mechanism is selected from the group consisting of an electrical detonator, a percussion detonator, a temperature activator, a chemical reaction activator, and combinations thereof.

17. The method of claim 10, wherein the impact fluid leaves the perforation unobstructed.

18. The method of claim 10, wherein the impact fluid penetrates a casing and a cement prior to penetrating the formation.

* * * * *